United States Patent [19]

Beeber

[11] Patent Number: 5,026,060

[45] Date of Patent: Jun. 25, 1991

[54] INDOOR GOLF GAME

[76] Inventor: Paul S. Beeber, 101 Bay Ave., Hicksville, N.Y. 11801

[21] Appl. No.: 518,999

[22] Filed: May 3, 1990

[51] Int. Cl.[5] ..... A63B 69/36

[52] U.S. Cl. ..... 273/176 F; 273/182 A; 273/181 F; 273/176 J; 273/DIG. 12

[58] Field of Search ..... 273/26 R, 26 A, 32 R, 273/35 R, 35 B, 176 R–176 AA, 176 B–176 H, 176 J, DIG. 12, 179 R, 181 R, 181 D, 181 F, 181 K, 184 R, 185 R, 182 R, 182 A, 181 A, 317, 348, 394, 400, 407, 408, 176 AB, 176 K

[56] References Cited

U.S. PATENT DOCUMENTS

| | | | |
|---|---|---|---|
| 1,012,820 | 12/1911 | Cory | 273/176 F |
| 1,043,308 | 11/1912 | Everson | 273/182 A |
| 1,660,339 | 2/1928 | Kaufmann | 273/184 R |
| 1,869,642 | 8/1932 | Woolman | 273/184 A |
| 1,899,860 | 2/1933 | Flower | 273/176 FA |
| 1,923,152 | 8/1933 | Kohn | 273/181 A |
| 1,927,741 | 9/1933 | Herbert | 273/182 A |
| 1,965,838 | 7/1934 | Hofflund | 273/182 A |
| 2,823,034 | 2/1958 | Bingham | 273/181 F |
| 3,684,293 | 8/1972 | Brooks | 273/176 F |
| 3,910,583 | 10/1975 | Appel et al. | 273/176 F |
| 4,395,042 | 7/1983 | Boswell | 273/176 B |
| 4,538,814 | 9/1985 | Cunningham | 273/176 F |
| 4,750,744 | 6/1988 | Michalec | 273/181 A |
| 4,948,141 | 8/1990 | Newman | 273/176 FA |

FOREIGN PATENT DOCUMENTS

| | | | |
|---|---|---|---|
| 2605525 | 4/1988 | France | 273/182 R |
| 1224982 | 3/1971 | United Kingdom | 273/176 F |

*Primary Examiner*—Edward M. Coven
*Assistant Examiner*—Sebastiano Passaniti
*Attorney, Agent, or Firm*—Michael I. Kroll

[57] ABSTRACT

An indoor golf game is provided having a plurality of playing areas in which each playing area is enclosed by a netting frame and consists of a golf driving enclosure from which a golf ball may be propelled by a player swinging a golf club at the golf ball. A fairway is located at one side of the golf driving enclosure, where subsequent shots of the golf ball may be played therefrom. A putting green having a hole therein is located behind the golf driving enclosure and the fairway, where additional subsequent shots of the golf ball may be played therefrom. A structure is provided for selectively conveying the golf ball in one instance from the golf driving enclosure to the putting green and in another instance from the golf driving enclosure to the fairway depending upon how the player hits the golf ball with the golf club within the golf driving enclosure. The object of the indoor golf game is to finally hit the golf ball into the hole in the putting green with the least amount of strokes of the golf club by the player in each playing area.

9 Claims, 3 Drawing Sheets

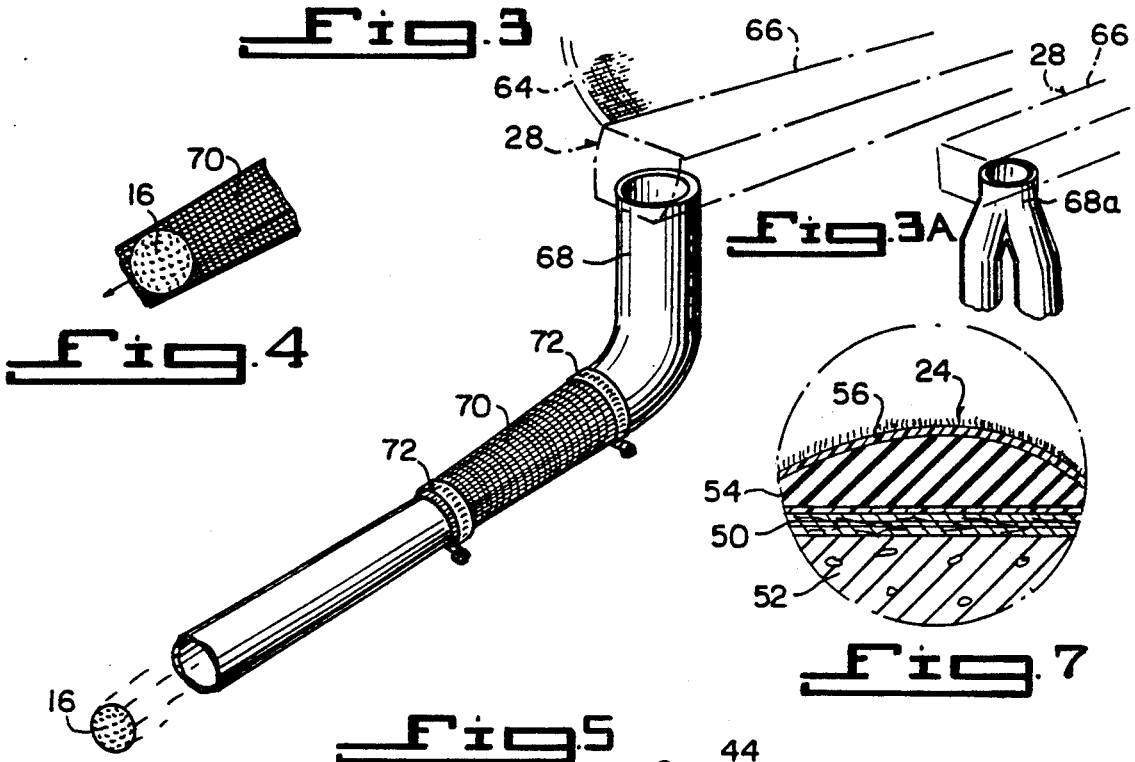
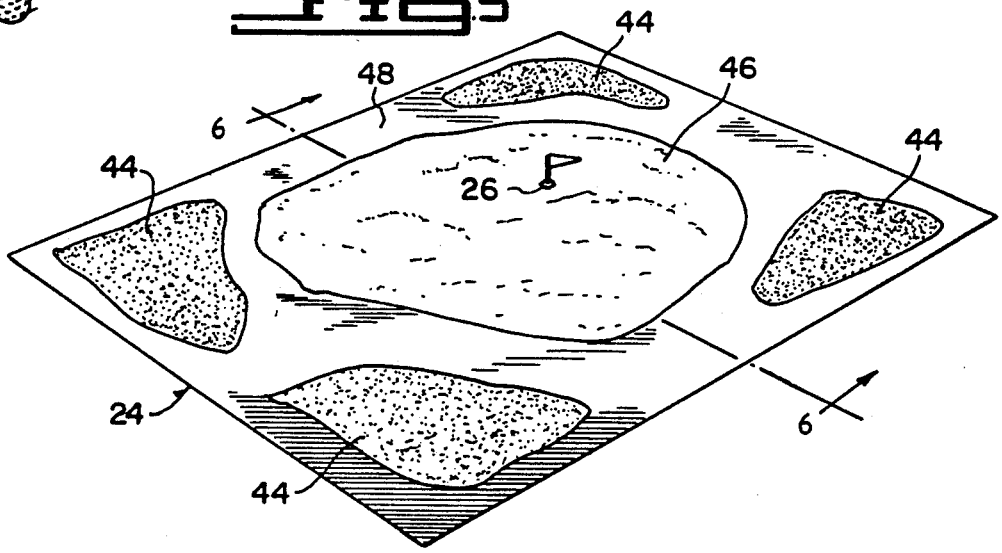
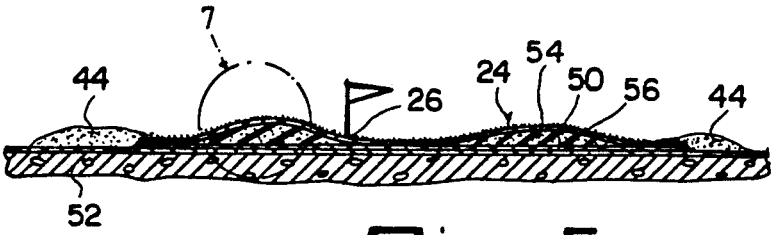
Fig. 6

INDOOR GOLF GAME

BACKGROUND OF THE INVENTION

1. Field of the Invention

The instant invention relates generally to golf games and more specifically it relates to an indoor golf game.

2. Description of the Prior Art

Numerous golf games have been provided in prior art that are adapted to simulate the play of golf within a limited confined area. For example, U.S. Pat. Nos. 1,869,642 to Woolman; 1,899,860 to Flower; 3,411,788 to Blanding; 3,599,980 to Harmond; 3,684,293 to Brooks; 3,910,583 to Appel et al and 4,215,865 to Pilati all are illustrative of such prior art. While these units may be suitable for the particular purpose to which they address, they would not be as suitable for the purposes of the present invention as heretofore described.

SUMMARY OF THE INVENTION

The invention is typically a nine hole indoor golf game using, a golf cage in which a player will use an iron (probably a number five iron) and will strike a golf ball off a tee, which will go into an angularly placed gutter at an end of the cage and feed into an appropriate place, either onto a green, a fringe of the green, sand trap or a fairway. The player will then have to "chip" to the green or putt depending on the position of the golf ball. The player will need a golf ball, a number five iron, a wedge and putter to play the indoor golf game. It can be played in approximately twelve thousand square feet. A fifteen thousand square foot building can house the indoor golf game with a miniature golf course for children.

A primary object of the present invention is to provide an indoor golf game that will overcome the shortcomings of the prior art devices.

Another object is to provide an indoor golf game that will give pleasure to each player during the play of the game when entering each playing area and completing its course to the hole.

An additional object is to provide an indoor golf game in which gutters and leaders are utilized to catch the golf ball and take it to one of a multiple of places in the playing area depending upon how the player hits the golf ball in a cage of the golf driving place.

A further object is to provide an indoor golf game that is simple and easy to use.

A still further object is to provide an indoor golf game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 3 is a perspective view of one leader broken away and showing a tapered tubular mess pipe installed therein to slow down the travel of the golf ball.

FIG. 3A is a perspective view of a double leader broken away so that the golf ball can travel into different parts of the fairway of the playing area.

FIG. 4 is a cross sectional view through the tubular mesh pipe shown in FIG. 3.

FIG. 5 is a perspective view of a typical putting green ground surface.

FIG. 6 is a cross sectional view taken along line 6—6 in FIG. 5, showing the internal structure of the putting green ground surface as in FIG. 1.

FIG. 7 is an enlarged cross sectional view as indicated by numeral 7 in FIG. 6, showing the various layers of material used in making up the putting green ground surface.

DETAILED DESCRIPTION OF THE PREFERRED EMBODIMENTS

Figures 1, 2, 2A:
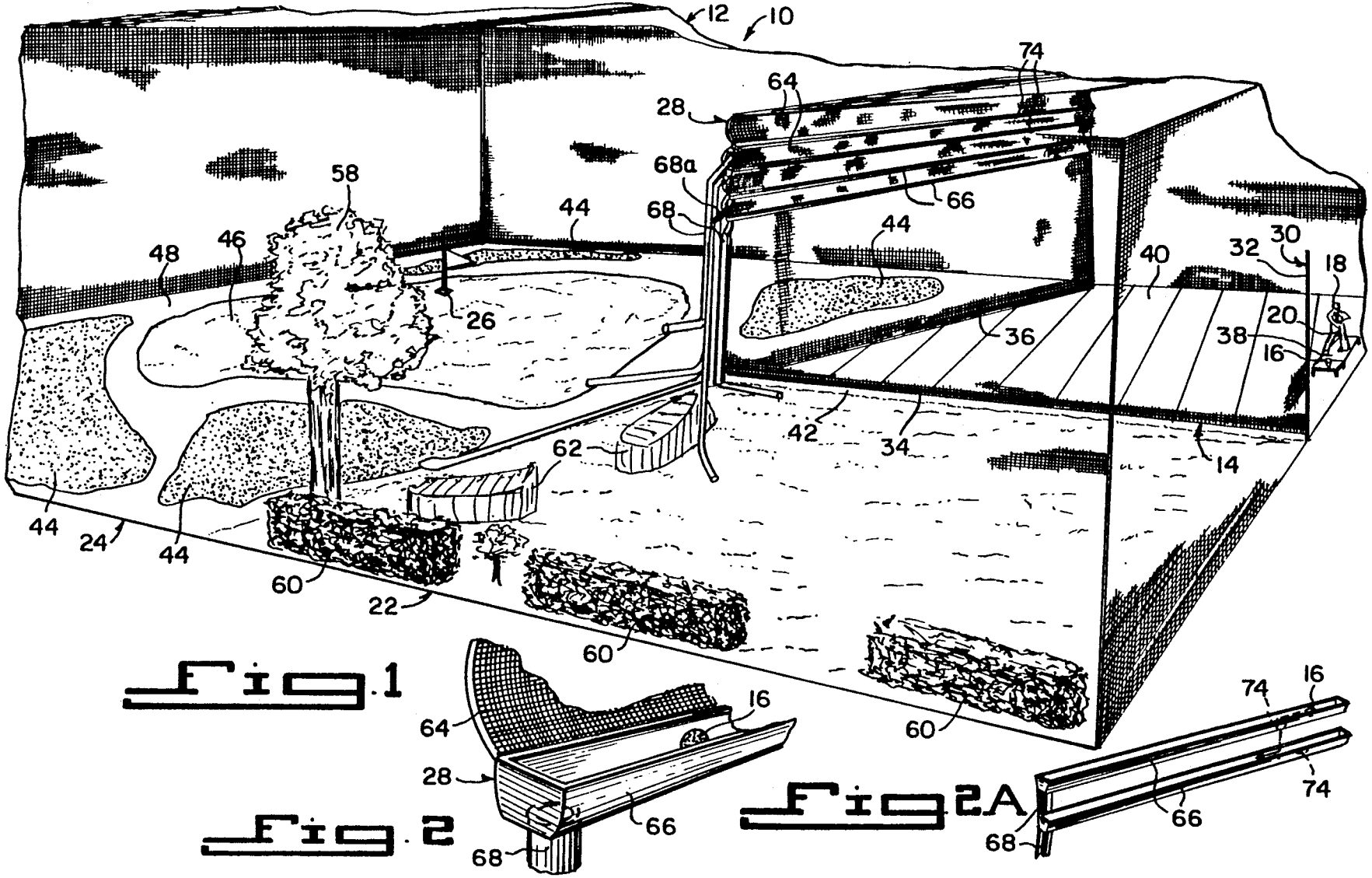
FIG. 1 is a perspective view with parts broken away showing one of the playing areas of the indoor golf game having a golf driving enclosure, a putting green and a fairway.
FIG. 2 is a perspective view of a part of one gutter, curved netting and leader as shown in FIG. 1.
FIG. 2A is a perspective view of two gutters showing staggered holes so that the golf ball can drop from one gutter to another thereby entering the sand trap segment rather an the green segment.
Figure 8A:
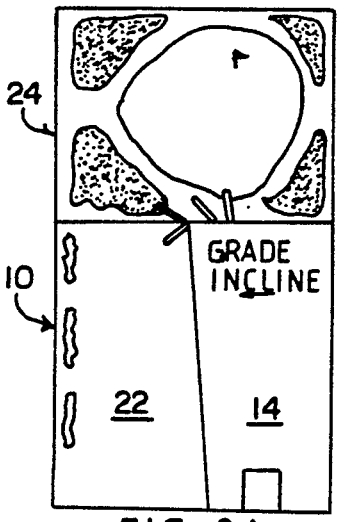
FIG. 8A is a diagrammatic top plan view showing the layout of a first playing area of the indoor golf game as in FIG. 1.
Figure 8B:
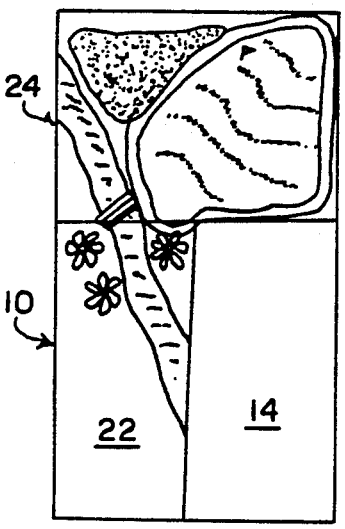
FIG. 8B is a diagrammatic top plan view showing the layout of a second playing area of the indoor golf game.
Figure 8C:
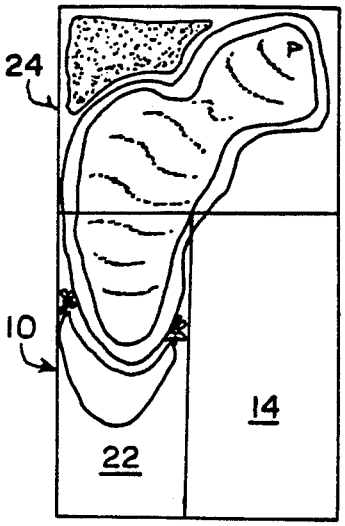
FIG. 8C is a diagrammatic top plan view showing the layout of a third playing area of the indoor golf game.
Figure 8D:
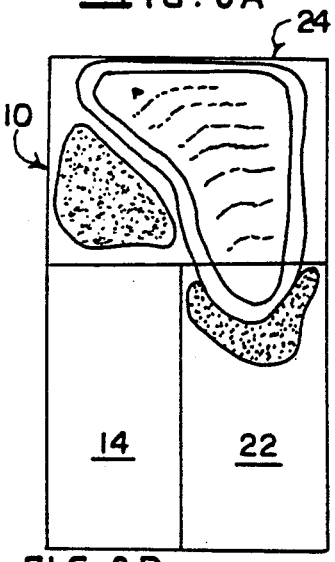
FIG. 8D is a diagrammatic top plan view showing the layout of a fourth playing area of the indoor golf game.
Figure 8E:
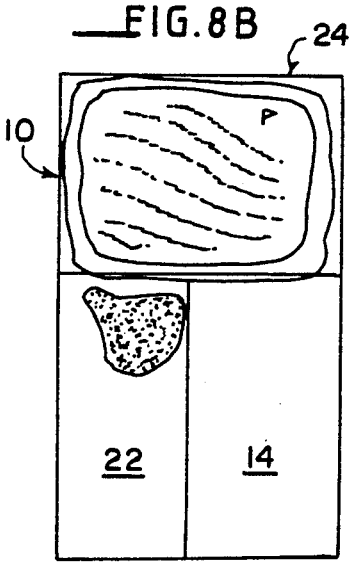
FIG. 8E is a diagrammatic top plan view showing the layout of a fifth playing area of the indoor golf game.
Figure 8F:
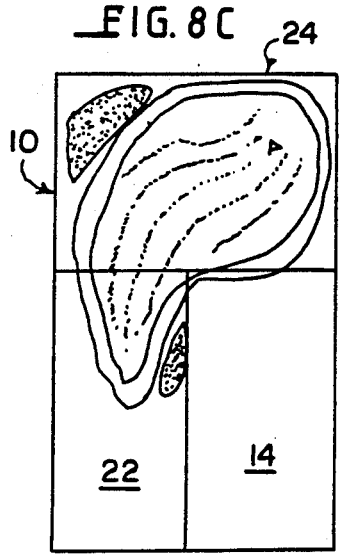
FIG. 8F is a diagrammatic top plan view showing the layout of a sixth playing area of the indoor golf game.
Figure 8G:
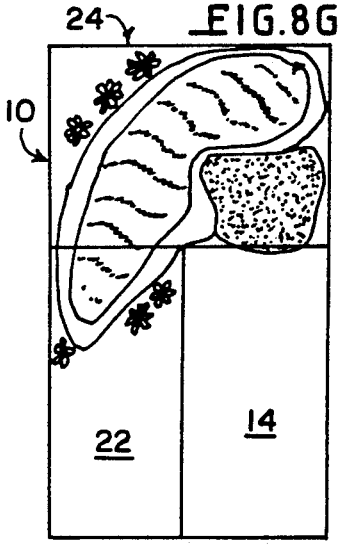
FIG. 8G is a diagrammatic top plan view showing the layout of a seventh playing area of the indoor golf game.
Figure 8H:
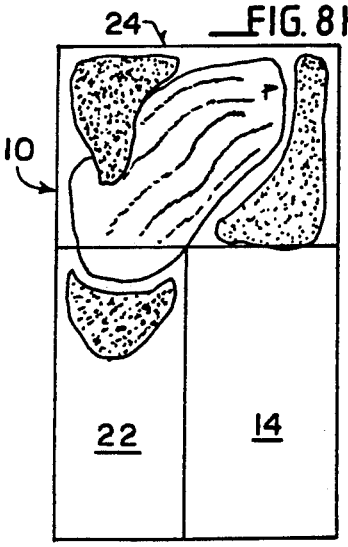
FIG. 8H is a diagrammatic top plan view showing the layout of an eighth playing area of the indoor golf game.
Figure 8I:
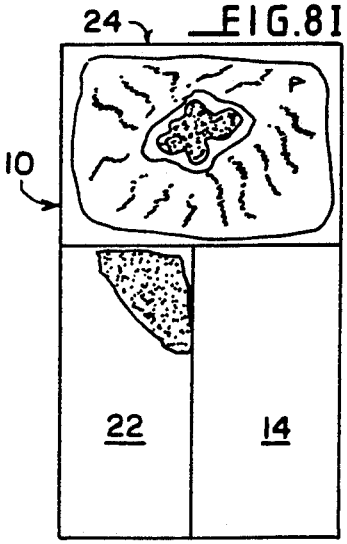
FIG. 8I is a diagrammatic top plan view showing the layout of a ninth playing area of the indoor golf game.

Turning now descriptively to the drawings, in which similar reference characters denote similar elements throughout the several views, FIG. 1 illustrates one playing area 10 of a plurality of playing areas of an indoor golf game. The playing area 10 is enclosed on all sides and top by a netting frame 12 and contains a golf driving enclosure 14 from which a golf ball 16 may be propelled by a player 18 swinging a golf club 20, such as a number five iron, at the golf ball 16. A fairway 22 is located at one side of the golf driving enclosure 14, where subsequent shots of the golf ball 16 may be played therefrom. A putting green 24 that has a hole 26 therein is located behind the golf driving enclosure 14 and the fairway 22, where additional subsequent shots of the golf ball 16 may be played therefrom.

A structure 28 is provided for selectively conveying the golf ball 16 in one instance from the golf driving enclosure 14 to the putting green 24 and in another instance from the golf driving enclosure 14 to the fairway 22 depending upon how the player 18 hits the golf ball 16 with the golf club 20 within the golf driving enclosure 14.

The golf driving enclosure 14 includes a cage 30 being a frame 32 with two netting walls 34 and 36 thereabout. An elevated tee platform 38, is at one end of the cage 30. A sloped angular floor 40 is in the cage 30. The side wall 34 of the cage 30 adjacent the fairway 22 is slightly elevated and thus has a space 42 therealong high enough to allow the golf ball 16 to roll under the side wall 34 onto the fairway 22. This allows a bad shot of the golf ball 16 to enter the fairway directly from the cage 30.

As best seen in FIGS. 1 and 5, the putting green 24 includes at least one sand trap segment 44, a green segment 46 having the hole 26 therein and a fringe segment 48 between the green segment 46 and the at least one sand trap segment 44.

As best seen in FIGS. 6 and 7, the putting green 24 is fabricated out of a carpet pad 50 on the cement floor 52, an angular foam pad 54 on the carpet pad 50 and polypropylene grass 56 on the foam pad 54 to simulate the feeling of a real putting green.

The fairway 22 includes a plurality of obstacles, such as at least one tree 58, a bush 60 and a hazard barrier 62. The hole 26 in the green segment 46 is located off to one side from the fairway 22, so as to make the subsequent shots of the golf ball 16 more difficult.

The structure 28 as shown in FIGS. 1 and 2, includes a plurality of curved nets 64, one above the other at the top of the rear netting wall 36 of the cage 30 of the golf driving enclosure 14 opposite the elevated tee platform 38. A plurality of gutters 66 are angularly positioned and spaced one above the other at the curved nets 64 so that one of the gutters 66 will receive the golf ball 16 dropping down from its respective curved net 64. These gutters 66 can be lowered and raised in each driving enclosure 14 to accept the trajectory of a ball 16 hit with a variety of clubs 20. A leader 68 is connected to the lowest portion of each gutter 66, so as to carry the golf ball to a predetermined spot in the puttting green 24 and in the fairway 22 depending how the player 18 hits the golf ball 16 from the elevated tee platform 38.

As shown in FIGS. 3 and 4, each leader 68 further includes a tapered tubular mesh pipe 70 installed therein by hose clamps 72 to slow down the travel of the golf ball 16 therethrough.

As shown in FIG. 3A the leader **68*a* can be of a double leader type connected to the lowest portion of the gutter 66 so that the golf ball 16 can travel into different parts of the fairway 22 of the playing area 10**.

As shown in FIGS. 1 and 2A, each gutter 66 further has a hole 74 therein placed diagonally starting from the highest portion from gutter to gutter so that the golf ball 16 can drop from one gutter to another gutter below to enter the sand trap segment 44 rather that the green segment 46 when the golf ball 16 is badly shot from the elevated tee platform 38.

FIGS. 8A to 8I show the various configurations of the different playing areas 10 for playing the indoor golf game. Nine are shown but other combinations can be utilized, such as eighteen, etc. The type of club 20 used in each playing area 10 can be changed by lowering or raising the gutters 66 in each driving enclosure 14 accepting a different trajectory, so that different irons or woods can be used throughout the game.

LIST OF REFERENCE NUMBERS

10—playing area
12—netting frame
14—golf driving enclosure
16—golf ball
18—player
20—golf club
22—fairway
24—putting green 26—hole in 24
28—selectively conveying structure
30—cage
32—frame of 30
34—side wall of 30
36—rear wall of 30
38—elevated tee platform in 30
40—sloped angular floor in 30
42—space between 34 and 22
44—sand trap segment on 24
46—green segment on 24
48—fringe segment on 24
50—carpet pad in 24
52—cement floor
54—angular foam pad in 24
56—polypropylene grass in 24
58—tree on 22
60—bush on 22
62—hazard barrier on 22
64—curved net of 28
66—gutter of 28
68—leader of 28
70—tapered tubular mesh pipe
72—hose clamp
74—hole in 66

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed in new and desired to be protected by Letters Patent is set forth in the appended claims:

1. An indoor golf game having a plurality of playing areas, in which each said playing area is enclosed by a netting frame and comprises:

(a) a golf driving enclosure from which a golf ball may be propelled by a player swinging a golf club at the golf ball, said golf driving enclosure including a cage being a frame with two netting walls thereabout, one being a rear netting wall, and an elevated tee platform at one end of said cage, and bad shot means for allowing a bad shot of the golf ball to enter said fairway directly, said bad shot mean including a sloped angular floor in said cage, and a side wall of said cage adjacent said fairway being slightly elevated; thus having a space therealong high enough to allow the golf ball to roll under said side wall onto said fairway;

(b) a fairway located to one side of said golf driving enclosure where subsequent shots of the golf ball may be played therefrom;

(c) a putting green having a hole therein located adjacent said golf driving enclosure and said fairway, where additional subsequent shots of the golf ball may be played therefrom; and (d) means for selectively conveying the golf ball after being struck by the player in one instance from said golf driving enclosure to said putting green and in another instance from said golf driving enclosure to said fairway depending upon how the player hits the golf ball with the golf club within said golf driving enclosure; whereby the object of said indoor golf game is to finally hit the golf ball into the hole in said putting green with the least amount of strokes of the golf club by the player in each said playing area.

2. An indoor golf game as recited in claim 1, wherein said putting green includes at least one sand trap segment, a green segment having a hole therein and a fringe segment between said green segment and said at least one sand trap segment.

3. An indoor golf game as recited in claim 2, wherein said putting green is fabricated out of a carpet pad on a cement floor, an angular foam pad on said carpet pad and polypropylene grass on said foam pad to simulate the feel of a real putting green.

4. An indoor golf game as recited in claim 3, wherein said fairway includes a plurality of obstacles, including at least one tree, a bush and a hazard barrier with the hole in said green segment located off to one side from said fairway so as to make the subsequent shots of the golf ball more difficult.

5. An indoor golf game as recited in claim 4, wherein said mean for selectively conveying includes:

(a) a plurality of curved nets, positioned one above the other, at the top of the rear netting wall of said cage of said golf driving enclosure opposite said elevated tee platform;

(b) a plurality of gutters angularly positioned and spaced one above the other at said curved nets so that one of said gutters will receive the golf ball dropping down from its respective said curved net; and (c) a plurality of leaders, each connected to the lowest portion of one of said gutters so as to carry the golf ball to a predetermined spot in said putting green and in said fairway depending how the player hits the golf ball from said elevated tee platform.

6. An indoor golf game as recited in claim 5, wherein each of said leaders further includes a tapered tubular mesh pipe installed therein to slow down the travel of the golf ball therethrough.

7. An indoor golf game as recited in claim 6, further including at least one double leader connected to the lowest portions of one of said gutters so that the golf ball can travel into different parts of said fairway of the playing area.

8. An indoor golf game as recited in claim 7, wherein each said gutter further has a hole therein placed diagonally starting from the highest portion from one said gutter to another said gutter so that the golf ball can drop from one said gutter to another said gutter below to enter said sand trap segment rather than said said green segment, when said golf ball is badly shot from said elevated tee platform.

9. An indoor golf game as recited in claim 8, wherein said gutters in each said driving enclosure can be lowered and raised to accept to different trajectory, so that different iron clubs and wood clubs can be used throughout the game at different holes.

* * * * *